United States Patent [19]

Beier

[11] Patent Number: 4,846,528

[45] Date of Patent: Jul. 11, 1989

[54] BODY WARMER

[76] Inventor: John K. Beier, 901 S. 89th, Omaha, Nebr. 68114

[21] Appl. No.: 71,430

[22] Filed: Apr. 11, 1988

Related U.S. Application Data

[63] Continuation-in-part of Ser. No. 48,262, May 11, 1987, Pat. No. 4,753,483.

[51] Int. Cl.[4] ..... A47C 31/00

[52] U.S. Cl. ..... 297/465; 2/69

[58] Field of Search ..... 2/69; 36/2.6; 297/465, 297/217; 126/204

[56] References Cited

U.S. PATENT DOCUMENTS

| | | | |
|---|---|---|---|
| 976,866 | 11/1910 | Gordon | 2/69 |
| 1,120,855 | 12/1914 | Schwarz | 2/69 |
| 1,302,179 | 4/1919 | Krotzer | 2/69 |
| 1,423,908 | 7/1922 | Burchard | 2/69 X |
| 2,230,689 | 2/1941 | Kemp | 2/69 |
| 2,442,105 | 5/1948 | Vacheron | 2/69.5 |
| 2,616,085 | 11/1952 | Bottolfsen | 2/69 |
| 2,705,325 | 4/1955 | Bogenberger | 2/69 |
| 2,712,133 | 7/1955 | Coleman | 2/69 |
| 3,329,971 | 7/1967 | Shelby | 2/69 |
| 3,597,764 | 8/1971 | Povey | 2/69 |
| 3,798,676 | 3/1974 | Shanks | 2/69.5 |
| 4,241,721 | 12/1980 | Holly | 126/204 |

*Primary Examiner*—James T. McCall

*Attorney, Agent, or Firm*—Zarley, McKee, Thomte Voorhees & Sease

[57] ABSTRACT

A body warmer adapted to be either removably secured to a rattan chair or the like or to a cushion secured to the chair. In one form of the invention, the body warmer has a sleeve at its upper back portion which is slipped over the top of the chair. In another form of the invention, the cushion is secured to the chair and snaps interconnect the body warmer with the cushion. In still another form of the invention, the body warmer includes additional cushioning material in the back portion thereof so that a cushion is not needed. In still another form of the invention, the body warmer is detachably connected to the cushion by means of snaps and also has a sleeve at its upper rearward portion which is slipped over the top of the chair. A foot warmer portion is removably secured to the lower end of the body warmer adapted to receive the feet of the person utilizing the body warmer.

4 Claims, 6 Drawing Sheets

BODY WARMER

CROSS REFERENCE TO RELATED APPLICATION

This is a continuation-in-part a of patent application Ser. No. 48,262 filed May 11, 1987, now Pat. No. 4,753,483.

BACKGROUND OF THE INVENTION

Body warmers or "snug sacks" are constructed much like a sleeping bag except that the snug sacks normally have an open lower end. The body warmer is normally wrapped around a person while the person is seated in a chair watching television, reading, etc.

One problem associated with the conventional body warmer is that the body warmer tends to fall from the chair when not in use thereby creating an untidy appearance. A further problem associated with the conventional body warmer is that it does not remain in position when being used.

Although the body warmer described in the co-pending application accomplishes all of its stated objectives, it has been found that it is advantageous or desirable in some instances to provide a foot warming portion which may be detachably mounted at the lower end of the body warmer.

It is therefore a principal object of the invention to provide an improved body warmer.

Yet another object of the invention is to provide a body warmer including means for operatively removably securing the body warmer to a chair.

Yet another object of the invention is to provide an improved body warmer including means for securing the body warmer to the seat cushion.

Yet another object of the invention is to provide a body warmer including means for securing the body warmer to a chair in such a manner so that it may be folded upon itself during periods of non-use.

Yet another object of the invention is to provide a body warmer which may be quickly and easily mounted on a chair or removed therefrom.

Yet another object of the invention is to provide a body warmer which has a foot receiving portion detachably mounted at the lower end thereof.

Still another object of the invention is to provide a body warmer which is economical of manufacture, durable in use and refined in appearance.

SUMMARY OF THE INVENTION

A body warmer is disclosed which may be wrapped around a person while the person is seated on a chair such as a rattan chair or the like. The rattan chair normally has a seat cushion secured thereto. In one form of the invention, the seat cushion is modified so as to provide snaps at both sides thereof and at the upper portion thereof. In the said one form of the invention, the body warmer has snaps provided thereon which may be snapped to the snaps on the cushion so that the body warmer will remain in position during periods of use and non-use. In another form of the invention, the body warmer includes additional cushioning in the rearward portion thereof so that it is not necessary to utilize a separate cushion. In this embodiment, a sleeve is secured to the upper rearward end of the body warmer which is adapted to be slipped over the upper back of the chair to aid in maintaining the body warmer in position. In still another embodiment of the invention, the body warmer is provided with snaps adapted to be secured to the snaps of the seat cushion and is also provided with a sleeve which extends over the upper back portion of the chair. In still another embodiment of the invention, the body warmer is provided with a removable foot warmer portion.

DESCRIPTION OF THE PREFERRED EMBODIMENT

Figure 2:
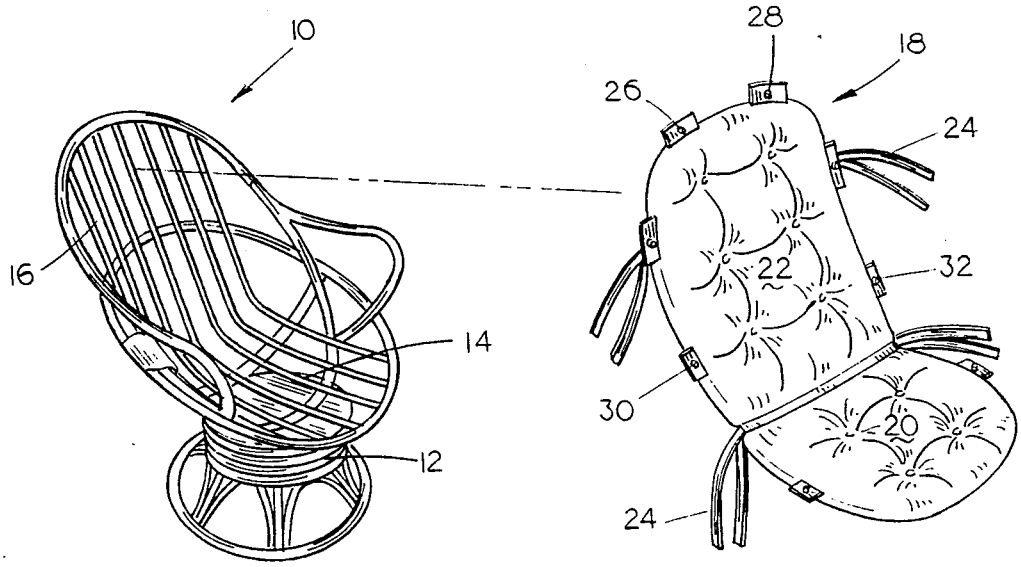
FIG. 2 is an exploded perspective view of a conventional rattan chair having a modified seat cushion associated therewith.
Figure 4:
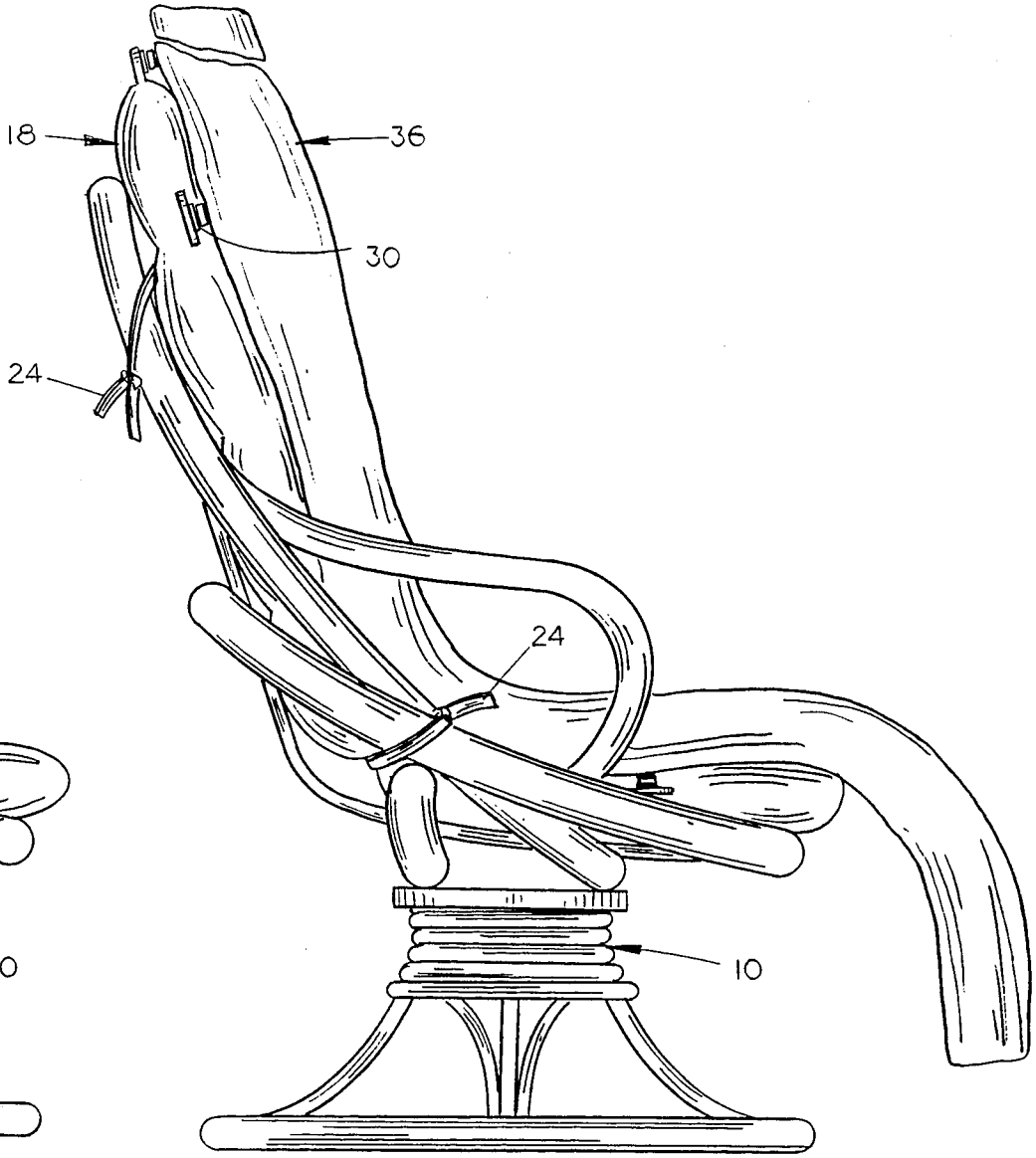
FIG. 4 illustrates the body warmer of this invention secured to the modified cushion of FIG. 3.
Figure 3:
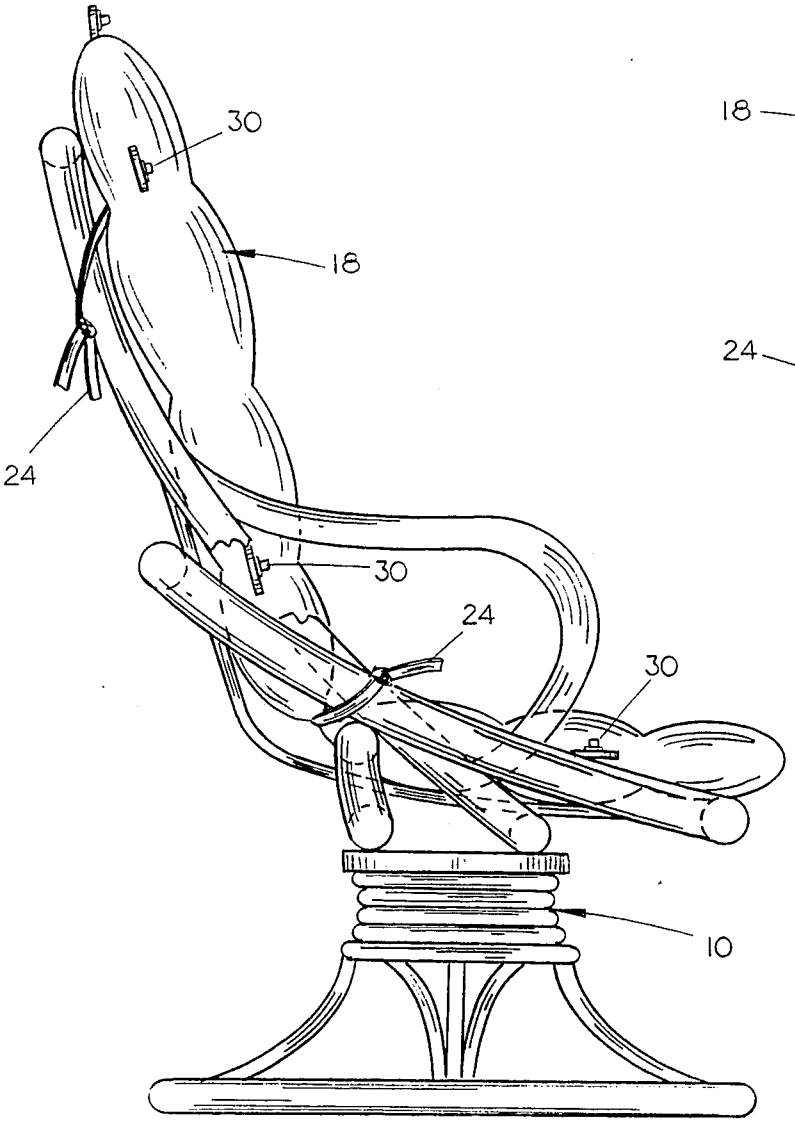
FIG. 3 is a side elevational view illustrating the modified cushion attached to the rattan chair.

The numeral 10 refers to a conventional bamboo or rattan chair including a base 12, seat portion 14 and back portion 16. A cushion is normally secured or mounted on the chair 10 and the conventional cushion may be modified to provide the cushion 18 illustrated in FIG. 2 or a new cushion 18 may be provided. Cushion 18 includes a seat portion 20 having a back portion 22 extending upwardly therefrom. A plurality of ties 24 are secured thereto to aid in securing the cushion to the chair. A pair of snaps 26 and 28 are provided at the upper end of back portion 22 and a plurality of snaps 30 and 32 are provided at opposite sides of the cushion 18 as seen in FIG. 2.

Figure 1:
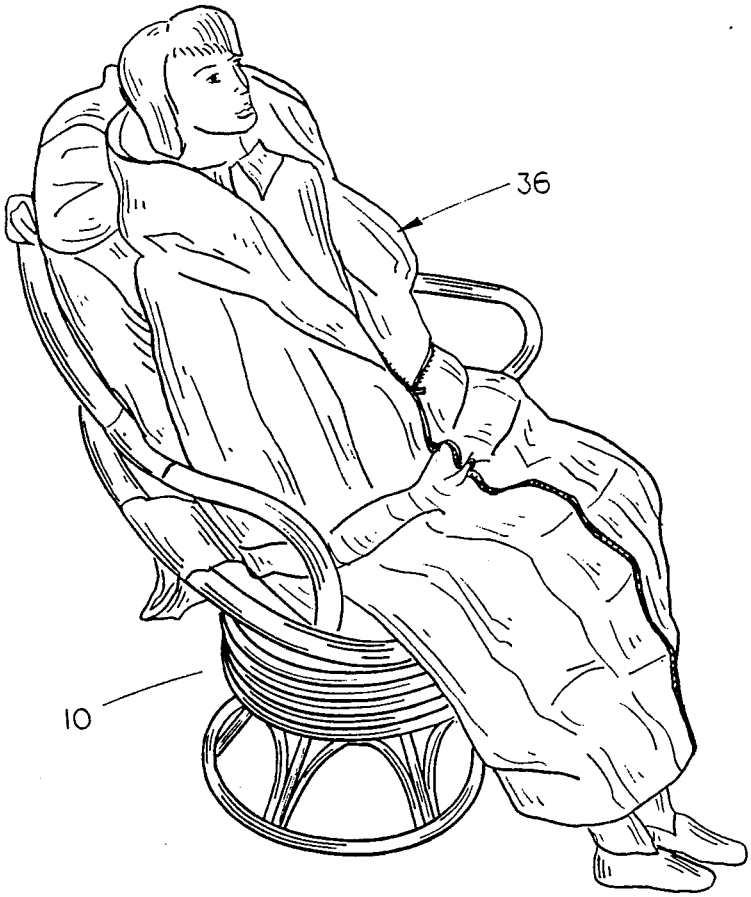
FIG. 1 is a perspective view illustrating the manner in which the body warmer of this invention is utilized in combination with a chair.

The body warmer of this invention is referred to generally by the reference numeral 36 and is conventional in design except for the snaps 37 and 38 provided at the upper end thereof and except for the snaps 40 provided at one side thereof and the snaps 42 (not shown) provided at the other side of the body warmer 36. As seen in the drawings, snaps 37 and 38 are positioned below the upper end of body warmer 36. Snaps 37 and 38 are adapted to be secured to the snaps 26 and 28 respectively while the snaps 40 are adapted to be secured to the snaps 30. The snaps 42 are designed to be secured to the snaps 32. Thus, chair 10 and cushion 18 may be used in conventional fashion during the summertime or the like. When it is desired to use the body warmer 36, the body warmer 36 is secured to the cushion 18 by means of the snaps as just described. A person may utilize the body warmer in the fashion illustrated in FIG. 1. During periods of non-use, the bottom portion of the body warmer 36 may be folded upwardly upon itself so as to present a neat appearance on the chair with the snap connections between the cushion and the body warmer maintaining the body warmer in position.

Figure 7:
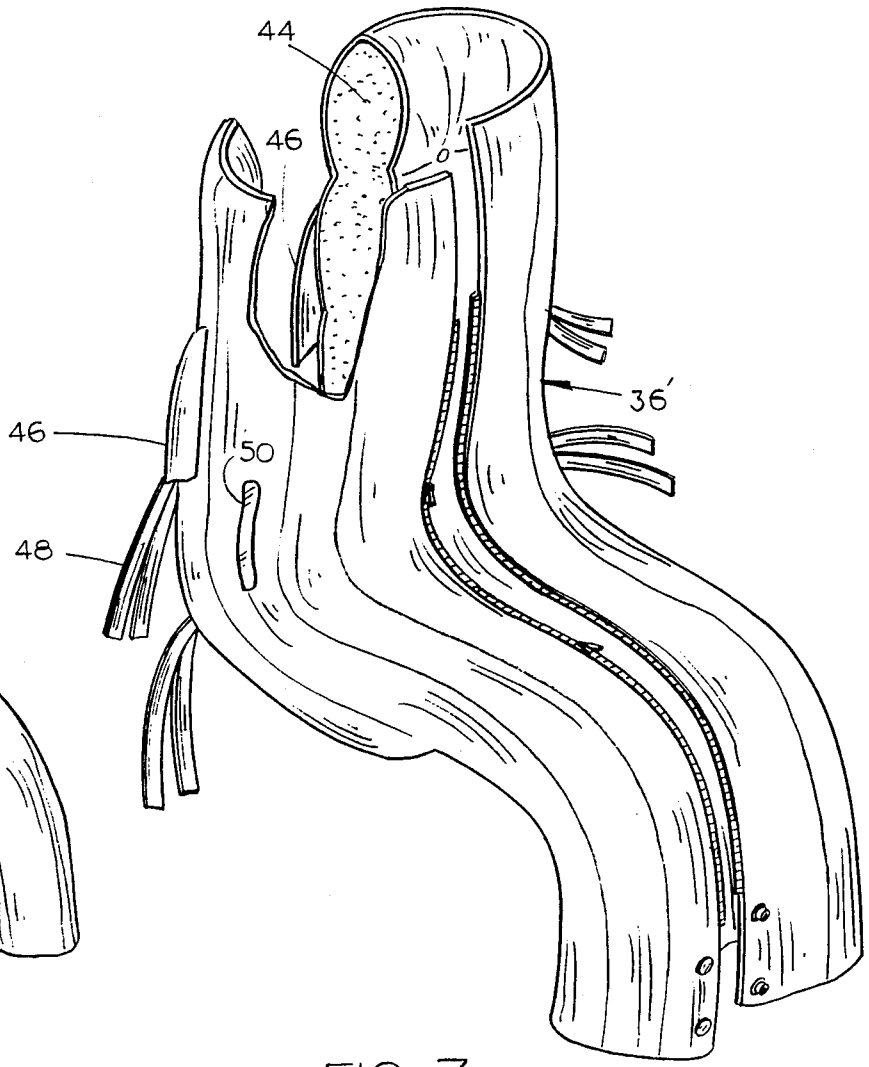
FIG. 7 is a perspective view of the modified body warmer of FIG. 6.
Figure 6:
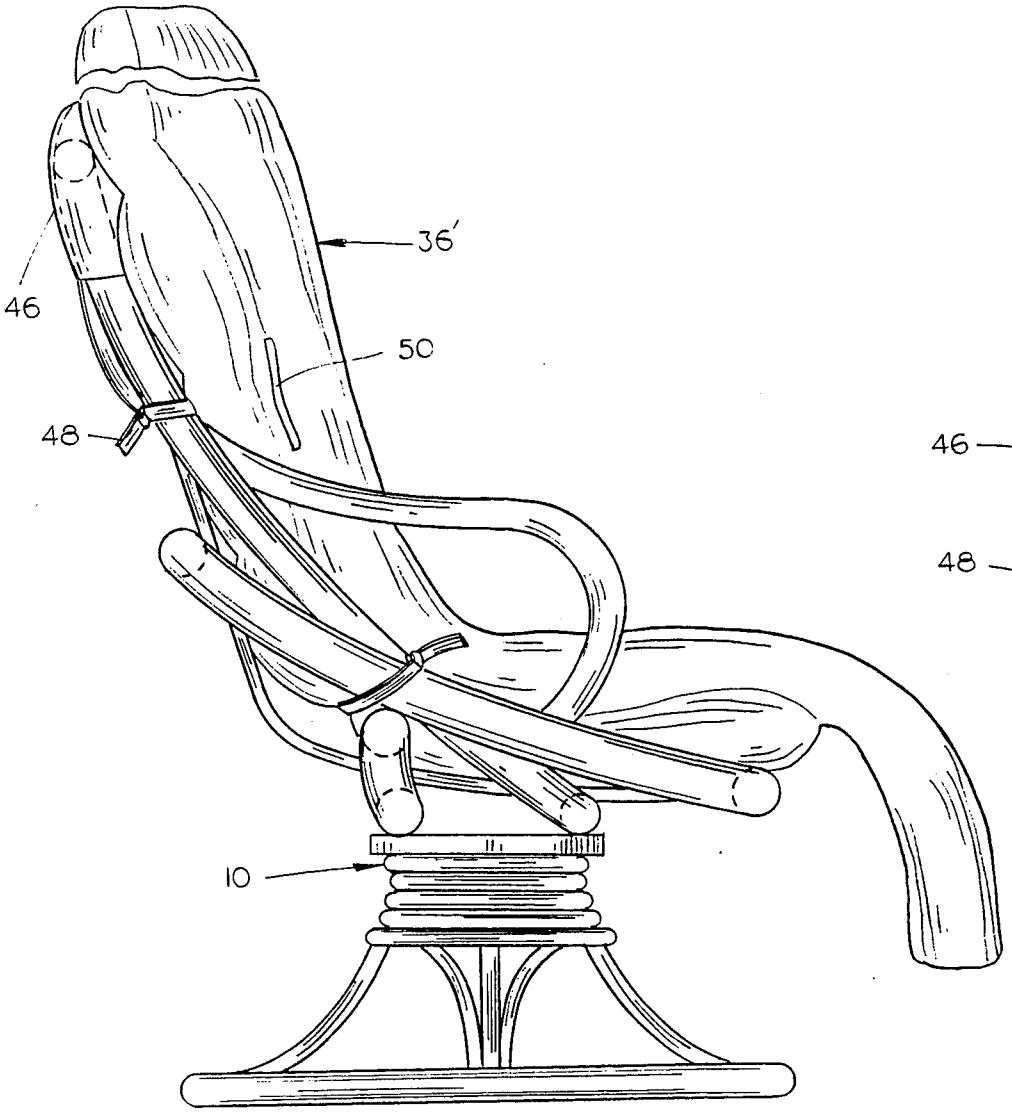
FIG. 6 is a side view similar to FIG. 4 except that a modified version of the body warmer is illustrated.

FIGS. 6 and 7 illustrate a modified form of the invention wherein the body warmer 36' includes additional cushioning material 44 in the back portion and seat portion thereof so that it is not necessary to employ a separate seat cushion. In the embodiment of FIGS. 6 and 7, a sleeve 46 is provided on the back portion thereof below the upper end thereof which may be slipped over the chair 10 in the manner illustrated in FIG. 6. A plurality of ties 37 are secured to the sleeve 46 to aid in securing the sleeve 46 to the chair. A plurality of ties 48 are also secured to the body warmer 36' to further attach the body warmer 36' to the chair.

Figure 5:
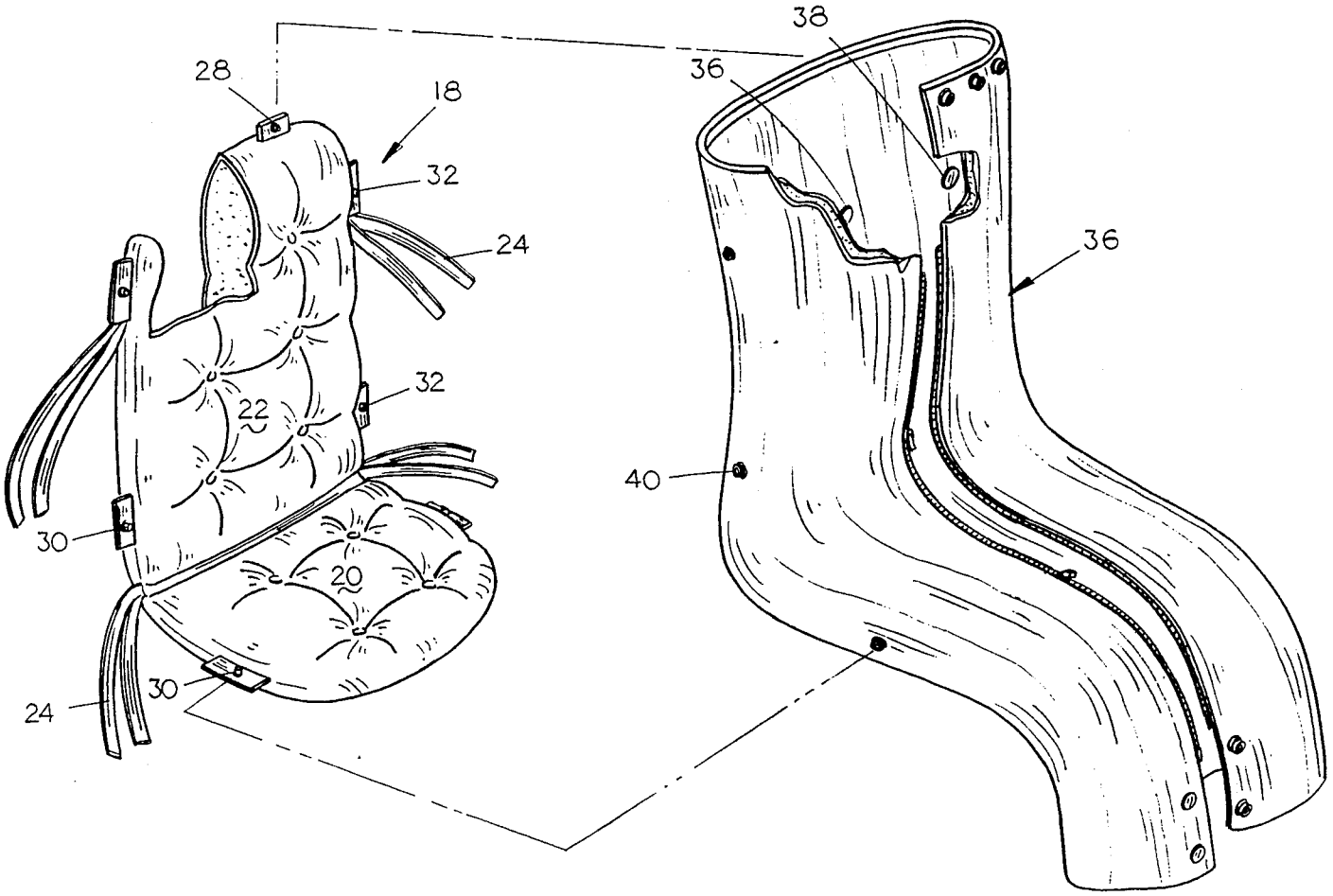
FIG. 5 is an exploded perspective view illustrating the body warmer of this invention and the modified seat cushion with a portion of the seat cushion cut away to illustrate the construction of the cushion.
Figure 9:
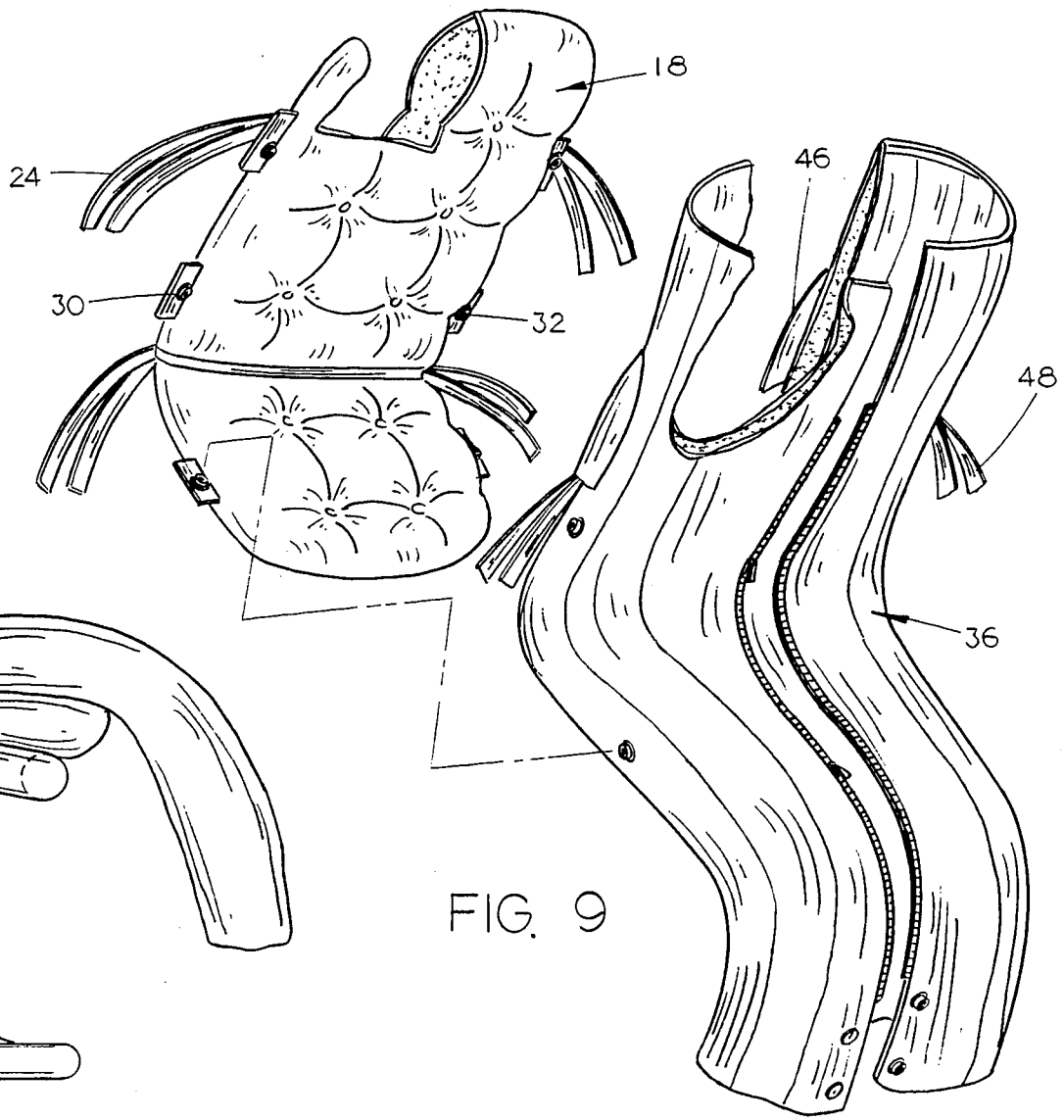
FIG. 9 is an exploded perspective view of the body warmer and cushion illustrated in FIG. 8 with a portion of the body warmer and cushion cut away to more fully illustrate the invention.
Figure 8:
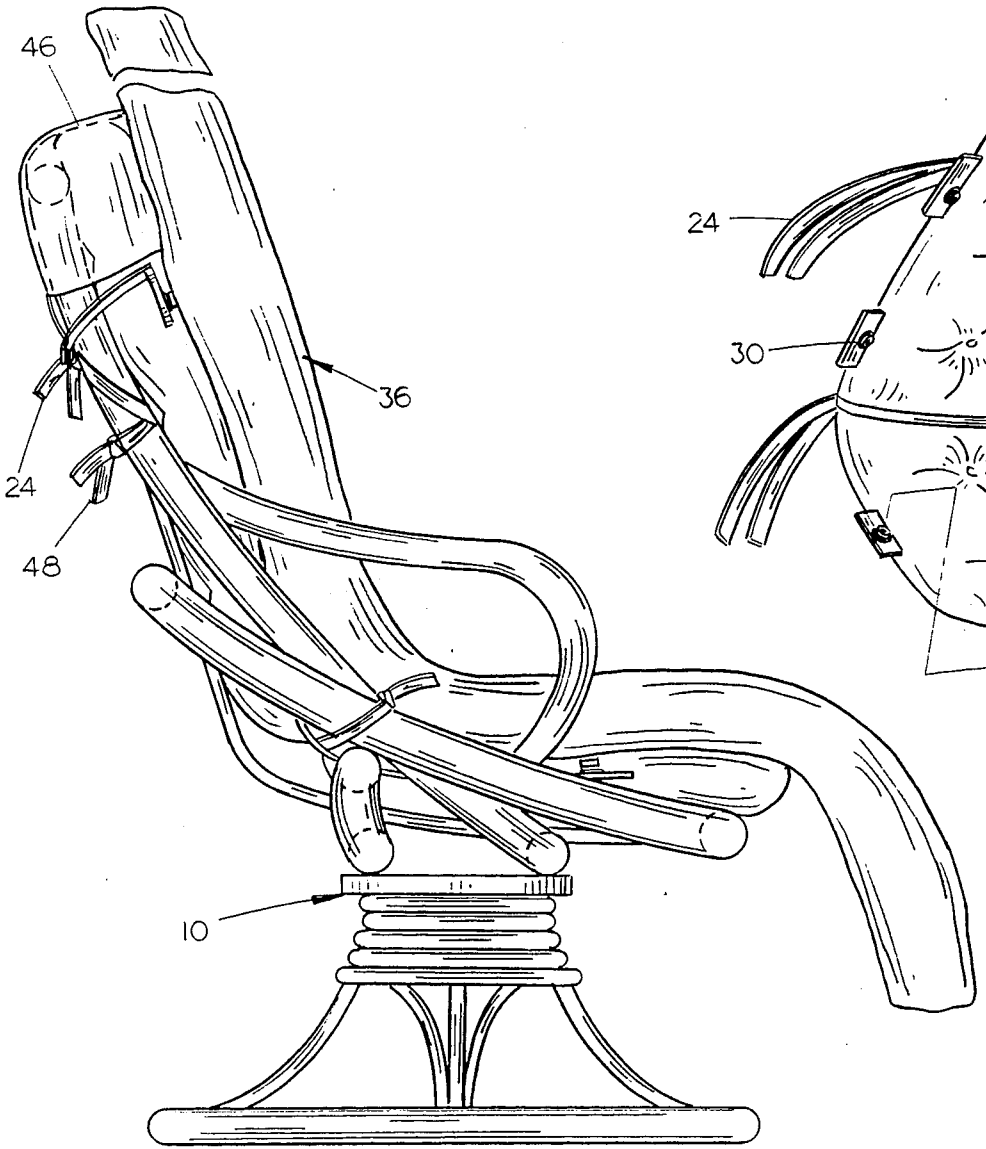
FIG. 8 is a view similar to FIG. 4 except that a still further modified form of the body warmer is illustrated.

The embodiment illustrated in FIGS. 8 and 9 is essentially the same as the embodiment of FIG. 5 except that the body warmer 36'' does not have the additional cushioning material in the back and seat portions thereof so that it will be used with a cushion 18 as illustrated in FIG. 8. The only difference between body warmer 36'' and 36 is that body warmer 36'' includes the sleeve 46'' on its back portion below the upper end thereof adapted to be slipped over the chair 18 as seen in FIG. 8. In all of the embodiments, it is preferred that the sack have a pair of arm receiving openings 50 formed therein to permit the person to extend his arms therethrough if desired.

Figure 10:
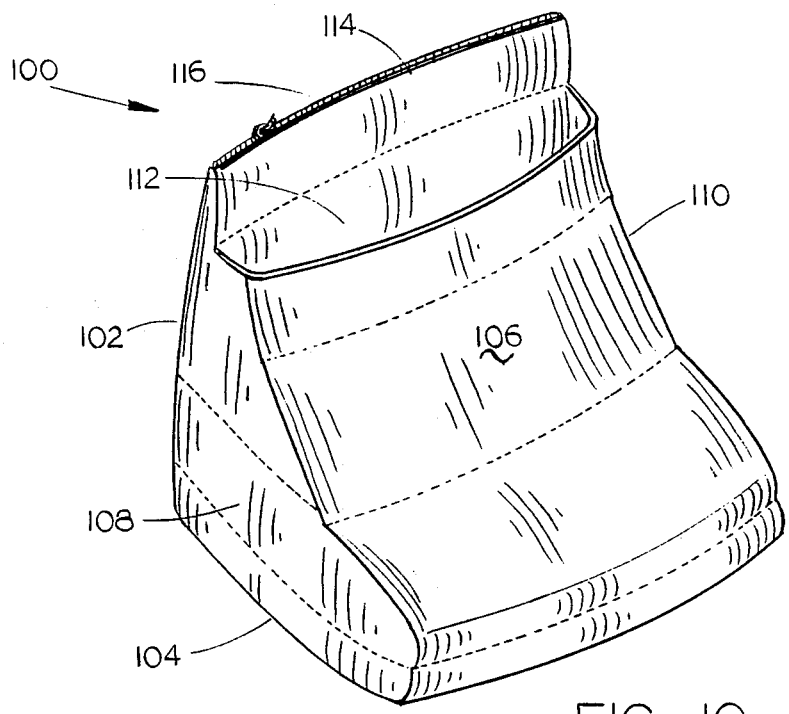
FIG. 10 is a perspective view of the foot warmer portion of the body warmer.

FIG. 10 is a perspective view of a foot warmer device which is adapted to be removably secured to the body warmer 36'''. The foot warmer of this invention is referred to generally by the reference numeral 100 and includes a back portion 102, bottom portion 104, front portion 106, and side panels 108 and 110. Back portion 102, bottom 104 and front portion 106 are formed from a single piece of material and are joined to the side panels 108 and 110 in the manner illustrated in FIG. 10 so that an opening 112 is created below the upper end 114. Opening 112 is designed to permit a person to position his or her feet within the interior of the foot warmer 100.

Figure 11:
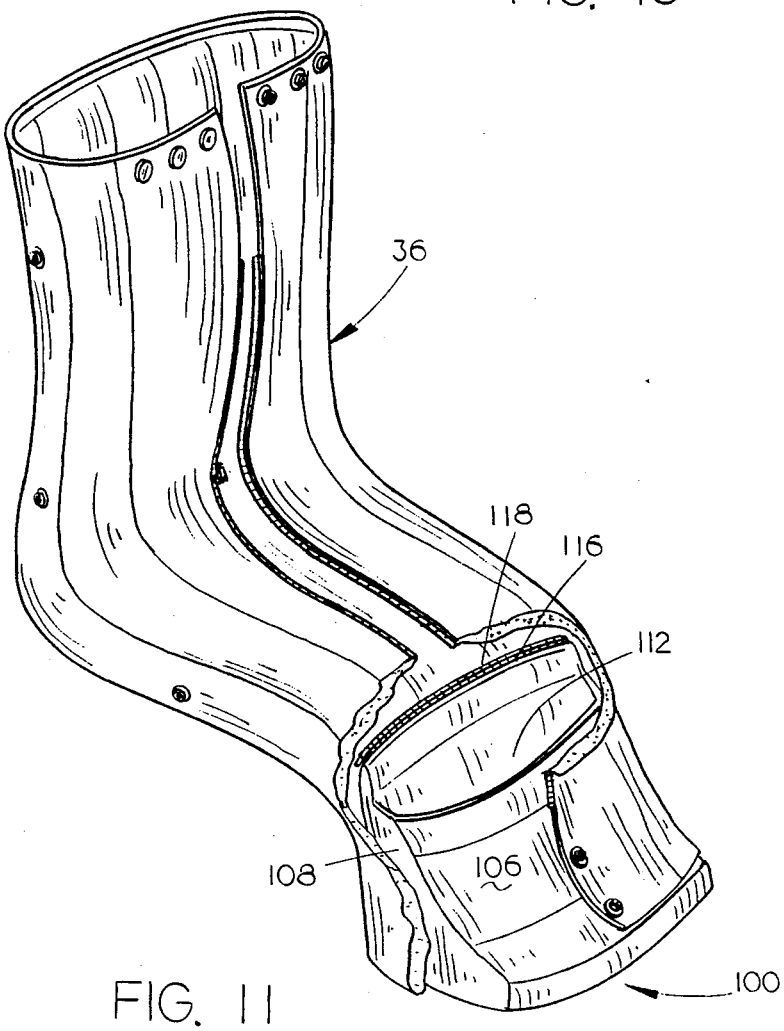
FIG. 11 is a perspective view of the body warmer of this invention having the foot warmer mounted thereon with portions of the body warmer being cut away to more fully illustrate the invention.

A zipper 116 is secured to back portion 102 at the upper end thereof and is adapted to be removably zippered to the zipper portion 118 on the interior of the body warmer 36''' as illustrated in FIG. 11. Zipper 116 may be replaced by suitable snaps or other convenient connection means. Zipper 118 is located with body warmer 36''' so that the lower end of back portion 102 dwells in approximately the same plane as the lower end of the body warmer 36'''.

The foot warmer 100 may be quickly and easily secured to the body warmer or removed therefrom as desired. When secured to the body warmer 36''', the foot warmer provides a convenient and warm device in which the person may insert his or her feet.

Thus it can be seen that novel body warmer or snug sack has been provided which enables the body warmer to be either secured to the chair by means of connection to the seat cushion or secured to the chair by means of ties and a sleeve. In all of the embodiments, the lower portion of the body warmer may be folded upwardly upon itself so as to present a neat appearance during periods of non-use. The connection means between the body warmer and the cushion or the connection means between the body warmer and the chair maintains the body warmer in position during periods of use and non-use. When the body warmer will not be used for some time, the body warmer may be removed from the chair in a convenient fashion and stored. Thus it can be seen that the invention accomplishes at least all of its stated objectives.

I claim:

1. In combination with a chair having a floor engaging support portion, a back portion and a cushion positioned thereon, a body warming sack adapted to be wrapped around a person, said sack having upper and lower ends, a front and a back, said sack having a length such that the lower end is positioned adjacent to the floor while the upper end extends to the top of said chair back portion.

connection means operatively removably securing said sack to the chair for maintaining said sack in position on the chair, and a foot warmer means removably secured to said sack adjacent the lower end thereof adapted to receive the feet of the person utilizing the body warming sack.

2. The combination of claim 1 wherein said foot warmer means has upper and lower ends, said foot warmer portion being secured to said body warming sack so that the lower end of said foot warmer portion dwells in approximately the same plane as the lower end of said body warming sack.

3. In combination with a chair having a floor engaging support portion, a seat portion, and a back portion extending upwardly from the seat portion, a body warming sack adapted to be wrapped around a person, said sack having upper and lower ends, a front and a back, said sack having a length such that the lower end is positioned adjacent the floor while the upper end extends to the top of said chair back portion, connection means operatively removably securing said sack to the chair for maintaining said sack in position on the chair, and a foot warmer means removably secured to said sack with an upper end in communication with the lower end of said sack, and adapted to receive the feet of the person utilizing the body warming sack.

4. The combination of claim 3 wherein said foot warmer means has upper and lower ends, said foot warmer portion being secured to said body warming sack so that the lower end of said foot warmer portion dwells in approximately the same plane as the lower end of said body warming sack.

* * * * *